US008201304B2

(12) United States Patent
Steurer et al.

(10) Patent No.: US 8,201,304 B2
(45) Date of Patent: Jun. 19, 2012

(54) COMPLIANT DOOR HINGE

(75) Inventors: Brian M. Steurer, Louisville, KY (US); Timothy Scott Shaffer, LaGrange, KY (US)

(73) Assignee: General Electric Company, Schenectady, NY (US)

( * ) Notice: Subject to any disclaimer, the term of this patent is extended or adjusted under 35 U.S.C. 154(b) by 562 days.

(21) Appl. No.: 12/392,290

(22) Filed: Feb. 25, 2009

(65) Prior Publication Data

US 2010/0212112 A1 Aug. 26, 2010

(51) Int. Cl.
*E05F 1/08* (2006.01)

(52) U.S. Cl. ..... 16/286; 16/289; 16/358; 16/361; 16/306; 126/194

(58) Field of Classification Search ..... 49/386, 49/387; 16/286, 287, 257, 261, 263, 323, 16/324, 289, 297, 344, 223, 306, 305, 343; 126/194, 191, 192, 190; 312/405, 228, 327, 312/328, 319.2, 319.3; 411/84, 85, 15
See application file for complete search history.

(56) References Cited

U.S. PATENT DOCUMENTS

| | | | | |
|---|---|---|---|---|
| 3,503,380 | A * | 3/1970 | Vasaturo | 126/191 |
| 3,820,866 | A | 6/1974 | Kaldenberg | |
| 4,817,240 | A * | 4/1989 | Sovis et al. | 16/297 |
| 5,291,634 | A | 3/1994 | Zanetti | |
| 5,341,542 | A | 8/1994 | Hannan et al. | |
| 5,402,552 | A * | 4/1995 | Chen | 16/228 |
| 6,892,424 | B1 | 5/2005 | Habegger et al. | |
| 7,150,071 | B2 * | 12/2006 | Collene et al. | 16/289 |
| 7,178,202 | B2 * | 2/2007 | Hirtsiefer et al. | 16/366 |
| 7,765,643 | B2 * | 8/2010 | Vanini | 16/286 |
| 2004/0172787 | A1 * | 9/2004 | Collene et al. | 16/289 |

* cited by examiner

*Primary Examiner* — Victor Batson
*Assistant Examiner* — Emily Morgan
(74) *Attorney, Agent, or Firm* — Global Patent Operation; Douglas D. Zhang

(57) ABSTRACT

An apparatus including a frame, a door and a compliant hinge mechanism hingably mounting the door to the frame, the compliant hinge mechanism including a resistance configured to provide a preload to balance the door in a first open position and an increasing force resisting further opening of the door when the preload is overcome and the door is opened past the first open position.

12 Claims, 8 Drawing Sheets

COMPLIANT DOOR HINGE

BACKGROUND OF THE INVENTION

The exemplary embodiments of the present invention generally relate to door hinges. More particularly, the exemplary embodiments relate to appliances with energy absorbing door hinges.

Generally, a conventional appliance with a horizontally hinged door, such as a stove, is anchored to a wall or floor by an anti-tip bracket to prevent the appliance from tipping when a load is applied to an open door of the appliance. An alternate concept described in prior art, but not widely used on appliance door hinges, are a break-away feature such that when a predetermined load is applied to the door when the door in an open position, the door is allowed to rotate past the open position with little or no resistance until the door contacts the floor or other stopping surface. While this break-away feature aids in preventing the appliance from tipping it may cause damage to the door, the floor or the user of the appliance. A load suddenly applied to the appliance door that exceeds a threshold load for operating the break-away feature may cause the door to accelerate to the floor. If the load is a utensil containing hot liquid, the accelerating nature of the door may cause undesired splashing or spilling of the utensil contents. As such, no commercial or residential ranges currently use break-away type hinges. Anti-tip brackets remain an industry standard.

The requirements for meeting static door loading, while in an open position, for foreseeable suddenly applied loads and preventing appliance tip over without the use of an anti-tip bracket involves a narrow performance range in which it is impractical to have a robust hinge design.

BRIEF DESCRIPTION OF THE INVENTION

As described herein, the exemplary embodiments overcome one or more of the above or other disadvantages known in the art.

One aspect of the exemplary embodiments relates to an apparatus. The apparatus includes a frame, a door and a compliant hinge mechanism hingably mounting the door to the frame, the compliant hinge mechanism including a resistance configured to provide a preload to balance the door in a first open position and an increasing force resisting further opening of the door when the preload is overcome and the door is opened past the first open position.

Another aspect of the exemplary embodiments relates to a method. The method includes applying a predetermined preload on a door of an appliance for balancing the door in a first open position, allowing the door to open past the first open position when a load applied to the door overcomes the preload and applying a resistive force to the door to resist opening of the door past the first open position where the resistive force is an increasing force dependent on an angle the door is opened past the first open position.

Still another aspect of the exemplary embodiments relates to a cooking appliance. The cooking appliance includes a frame, a door and a compliant hinge mechanism hingably mounting the door to the frame, the compliant hinge mechanism including a resistance configured to provide a preload to balance the door in a first open position and an increasing force resisting further opening of the door when the preload is overcome and the door is opened past the first open position.

These and other aspects and advantages of the exemplary embodiments will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and that, unless otherwise indicated, they are merely intended to conceptually illustrate the structures and procedures described herein. In addition, any suitable size, shape or type of elements or materials could be used.

DETAILED DESCRIPTION OF THE EXEMPLARY EMBODIMENTS OF THE INVENTION

Figure 1A:
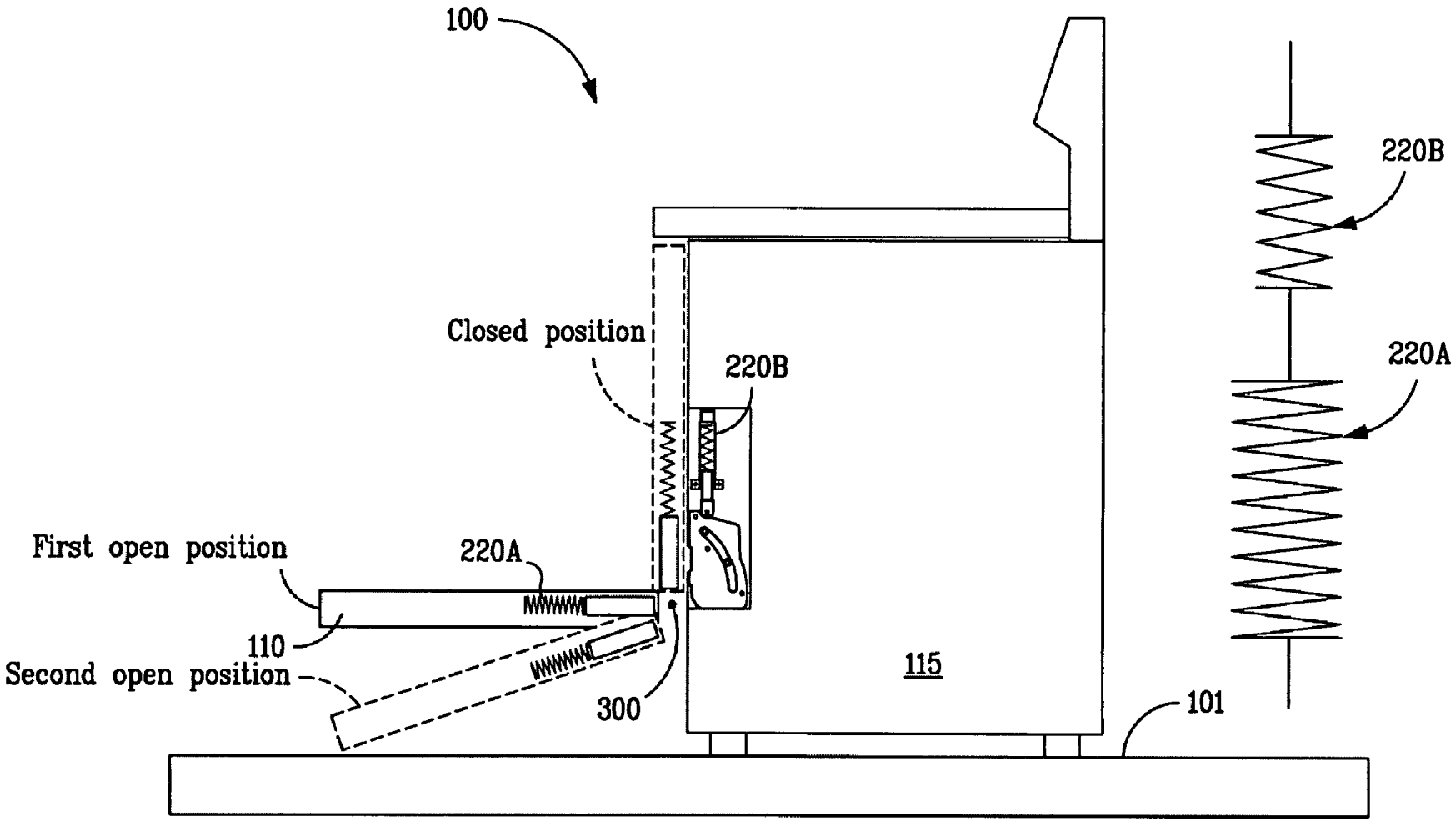
FIG. 1A illustrates an exemplary appliance including a hinge system in accordance with an exemplary embodiment.
Figure 1B:
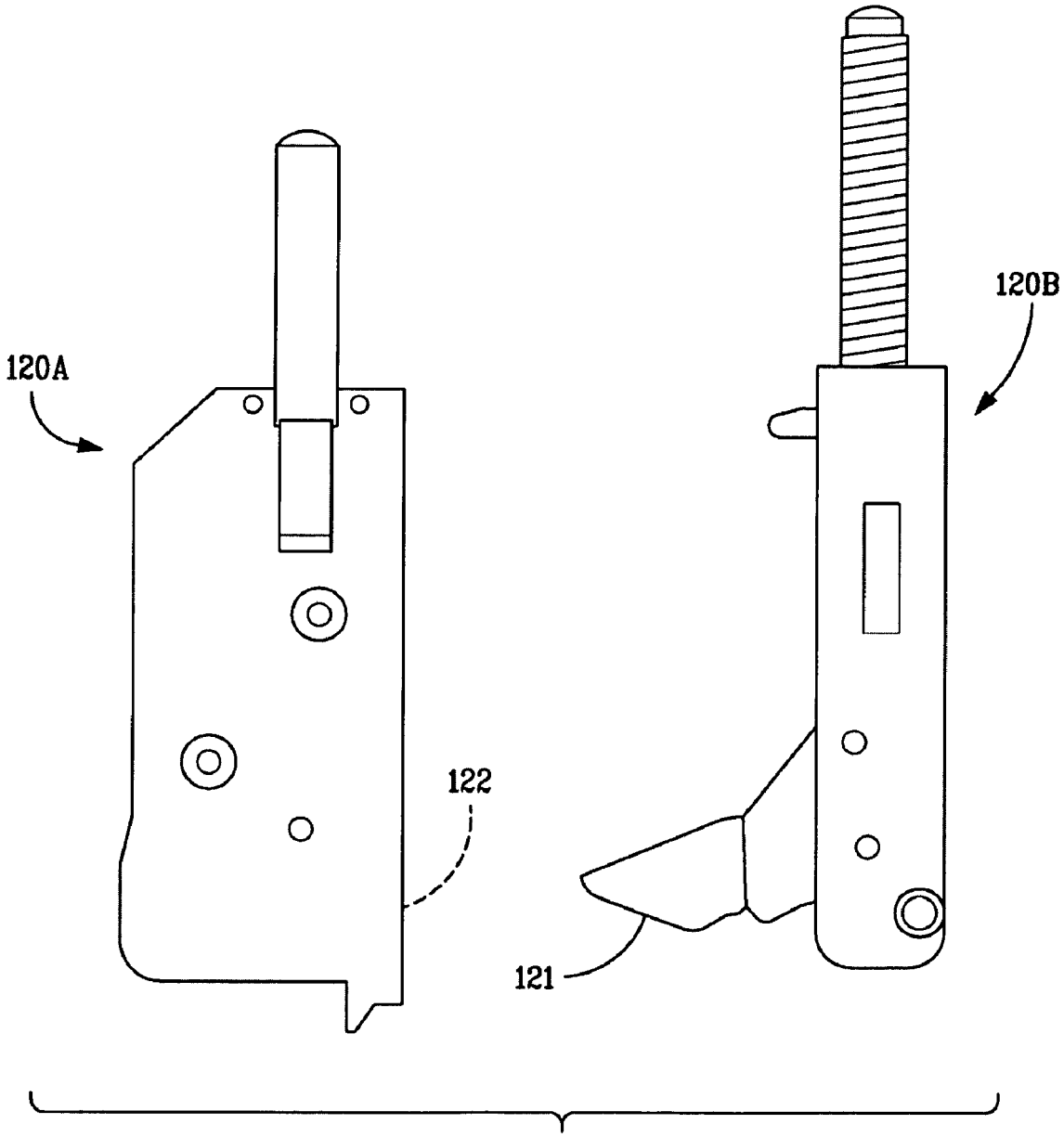
FIG. 1B illustrates the two main components of the hinge system of FIG. 1A.
Figure 1C:
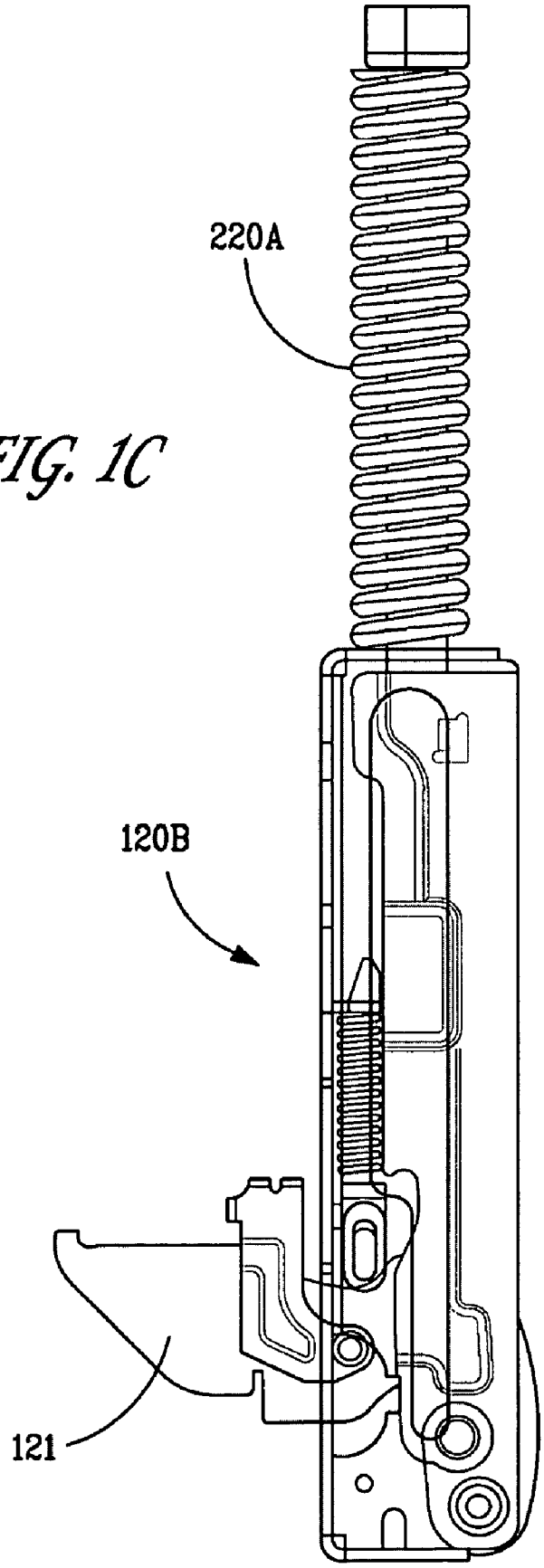
FIG. 1C illustrates the hinge component of the hinge system of FIG. 1A.

FIG. 1A illustrates an exemplary appliance 100 in accordance with an exemplary embodiment. In this example the appliance 100 is shown as a cooking appliance such as for example, a freestanding range or a slide in range having a hinged door 110. The door is hingably attached to, for example, a frame 115 of the appliance 100 through a hinge system 120 so that the door 110 is moveable between at least a closed position and an open position. It should be noted that while the exemplary hinge systems are described herein with respect to cooking appliance 100, in alternate embodiments the hinge systems may be applied to any suitable appliance including a hinged door including, but not limited to, dishwashers and clothes washers and dryers.

In accordance with an exemplary embodiment, the hinge system 120 is configured to control door motion when a load is applied to the door 110 while the door 110 is in a first open position (shown in FIG. 1A) so that the door 110 controllably moves toward or to a second open position (also shown in FIG. 1A). The first open position of the door 110 may be when, for example, the door 110 is at about a 85-90 degree angle relative to its closed position and the second open position may be when, for example, the door 110 opens past the first open position or over-travels up to about a 108-110 degree angle relative to the closed position (or until the door 110 contacts a surface such as floor 101 on which the appliance 100 is situated) as illustrated in FIG. 1A. In one example, the door motion is controlled through a preloaded resistance that controls when deflection of the door past the first open position occurs. The hinge system 120 allows the door 110 to rotate past the first open position when a predetermined preload applied by the resistance is overcome such that the amount of the normal force on the door 110 changes to allow for larger forces being applied to or by the door 110 without the appliance 100 tipping over. In accordance with the exemplary embodiments, the force required to rotate the door 110 toward the second open position increases the further the door 110 is opened past the first open position.

Referring to FIGS. 1A, 1B, 1C and 2A, in accordance with an exemplary embodiment, the hinge system 120 includes a receiver 120A that is attached or mounted to the frame 115 of the appliance 100 and a hinge component 120B that is attached or mounted to the door 110. The hinge component 120B includes a hinge claw 121 that is received in an opening 122 of the receiver 120A, and a door balance spring 220A. The hinge component 120B is well known in the art, and therefore will not be discussed in detail here. In this example, the receiver 120A includes a compliant hinge mechanism 290 that allows the amount of the normal force on the door 110 to change to allow for larger forces being applied to the door 110 without the appliance 100 tipping over. It is noted that while the compliant hinge mechanism 290 is described herein as being included in the receiver 120A, in alternate embodiments the compliant hinge mechanism 290 may be incorporated into the hinge component 120B. In still other alternate embodiments, the components of the complaint hinge mechanism 290 may be shared between or located in both of the receiver 120A and the hinge component 120B.

Figure 2A:
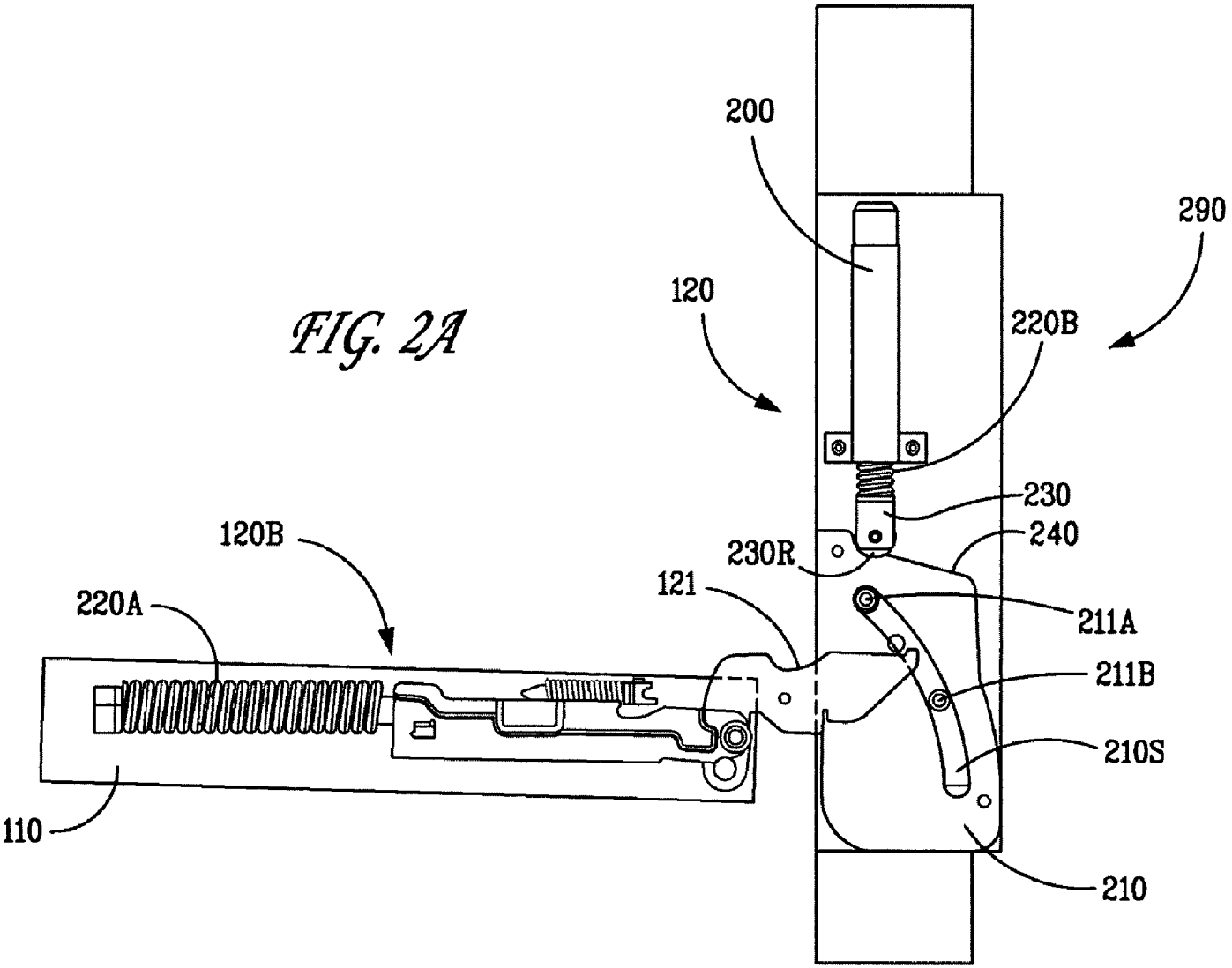
FIGS. 2A and 2B are schematic illustrations of the operation of the hinge system of FIG. 1A.
Figure 2B:
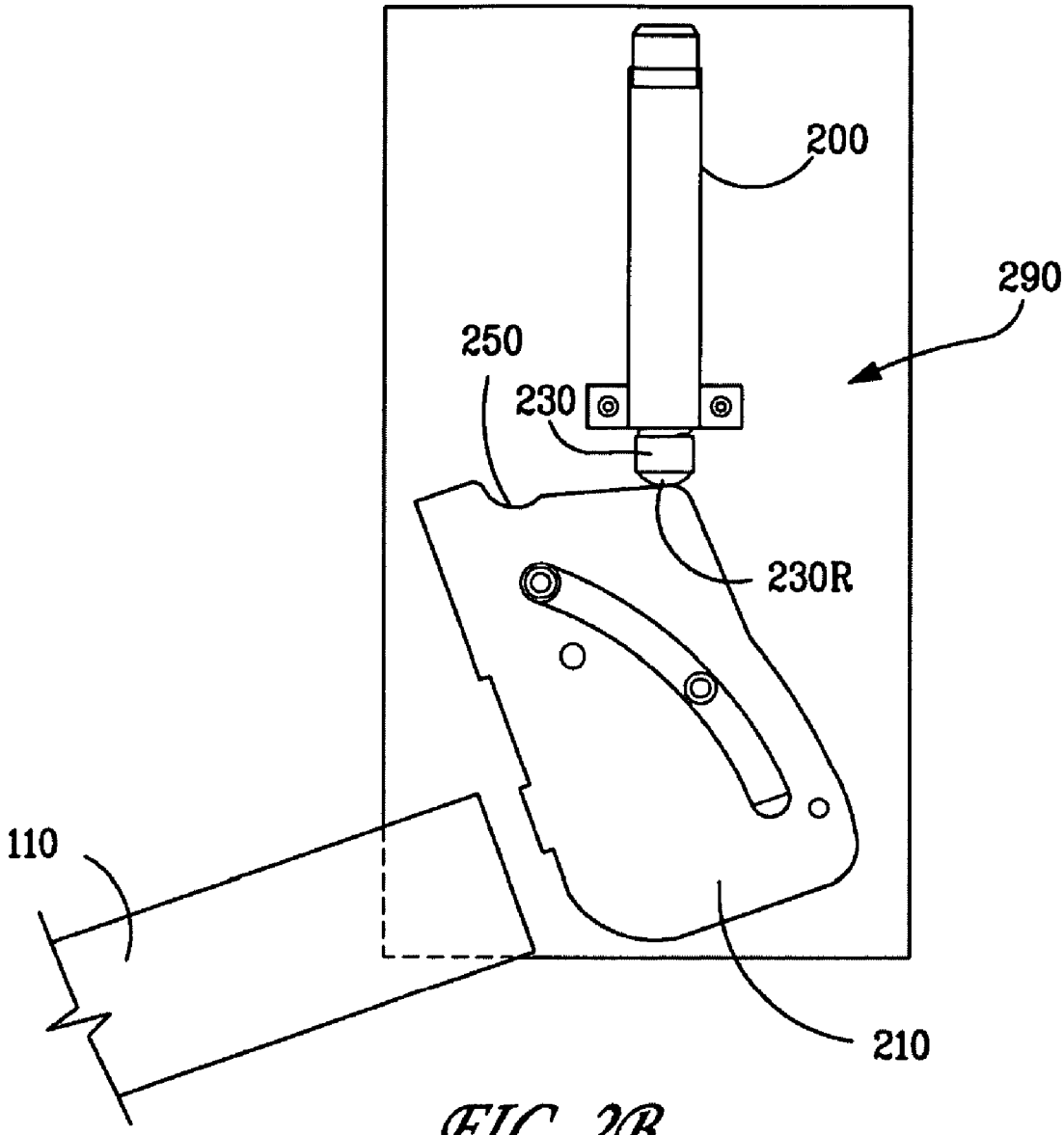

Referring to FIGS. 1A and 2A, in accordance with an exemplary embodiment, the compliant hinge mechanism 290 includes, for example, a pivoting member 210 and a spring housing 200. The pivoting member 210 is configured to pivot relative to the main body of the receiver 120A via, for example, slot 210S and pins or rollers 211A, 211B affixed to the main body of the receiver 120A. The pivoting member 210 receives the hinge claw 121 of the hinge component 120B such that the movement of the hinge claw 121 when the door 110 is opened past the first open position causes the pivoting movement of the pivot member 210 relative to the main body of the receiver 120A as described below. The pivoting member 210 also includes a detent 250 (see FIG. 2B) and a cam surface 240.

The spring housing 200, which is fixedly attached relative to the frame 115, is configured to house a resistance 220B. The resistance 220B may include any suitable spring such as, for example, a coil spring that is configured to be placed over, for example, a shaft or other suitable guide member which is movable relative to the spring housing 200, with the lower end of the spring being fixedly attached to the shaft. The shaft is preferably coupled to a follower 230 such that the resistance 220B provides a predetermined preload on the follower 230 as will be described in greater detail below. The follower 230 preferably includes a roller 230R or other contact member that is configured to engage the detent 250 and move along the cam surface 240.

In one embodiment, the preload provided by the resistance 220B may force the roller 230R into the detent 250 for substantially preventing movement of the pivoting member 210 while the door 110 of the appliance 100 is open in the first open position as shown in FIG. 1A. When a force sufficient to overcome the preload is applied to the door 110, the roller 230R disengages the detent 250 and moves along the cam surface 240. The pivoting member 210 is configured so that as the roller 230R moves along the cam surface 240, the resistance 220B provides an increasing force that acts against the pivoting action of the pivoting member 210 to return the door 110 back towards, for exemplary purposes only, the first open position.

Figure 3A:
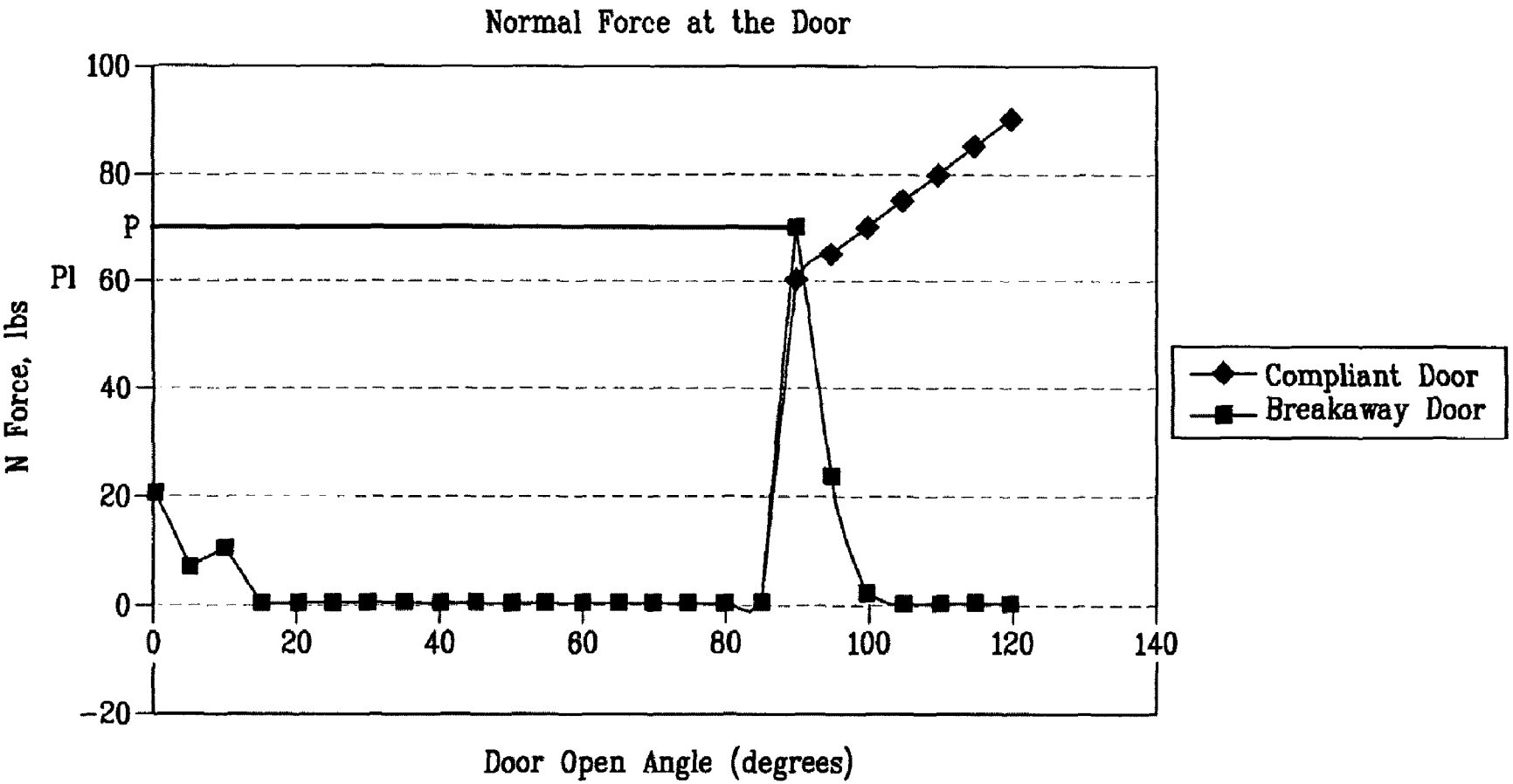
FIG. 3A is a graph illustrating a position of the door of the appliance of FIG. 1A relative to a force applied to the door.
Figure 3B:
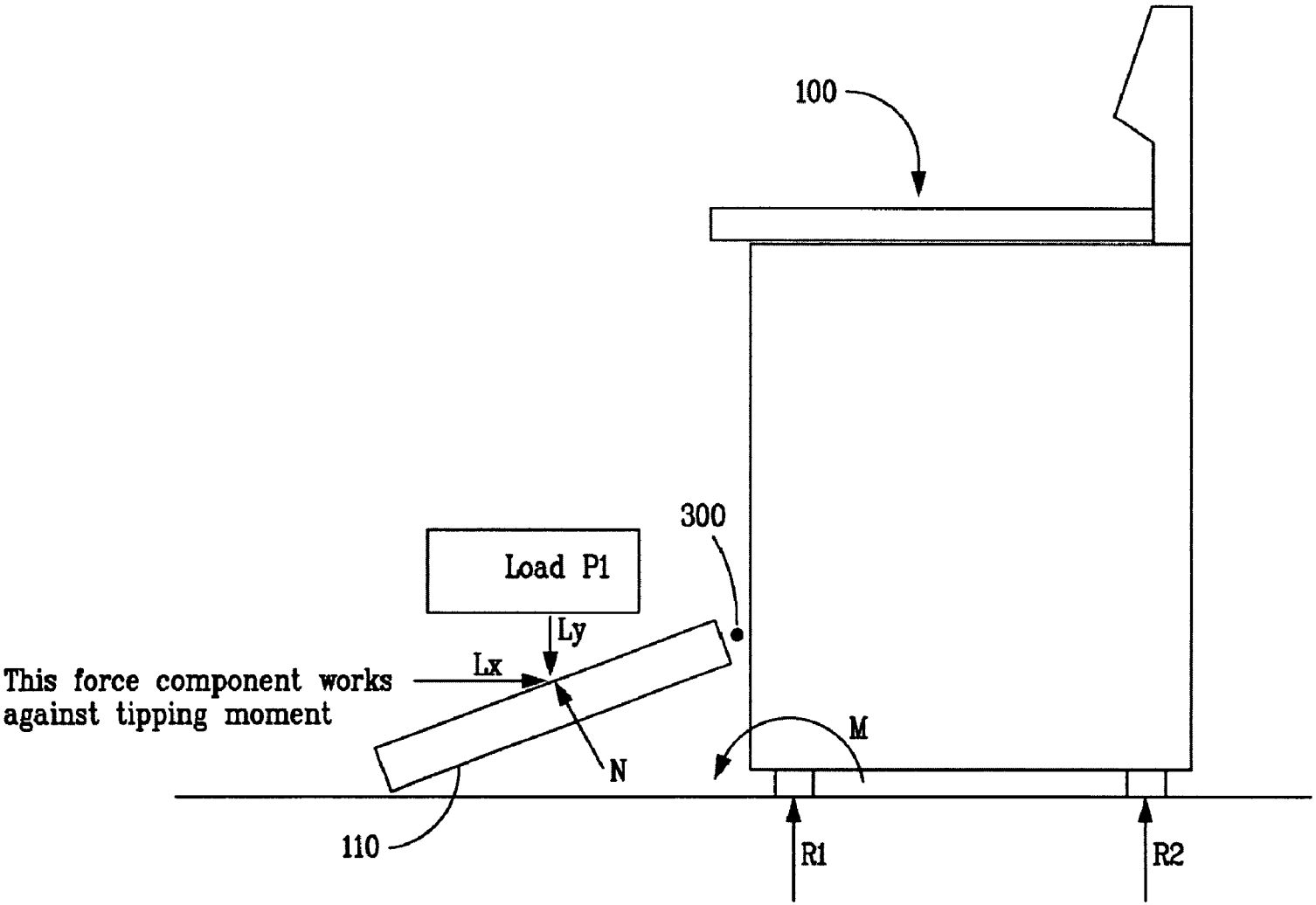
FIG. 3B illustrates an exemplary force diagram regarding the load applied to the door of the appliance of FIG. 1A.
Figure 4:
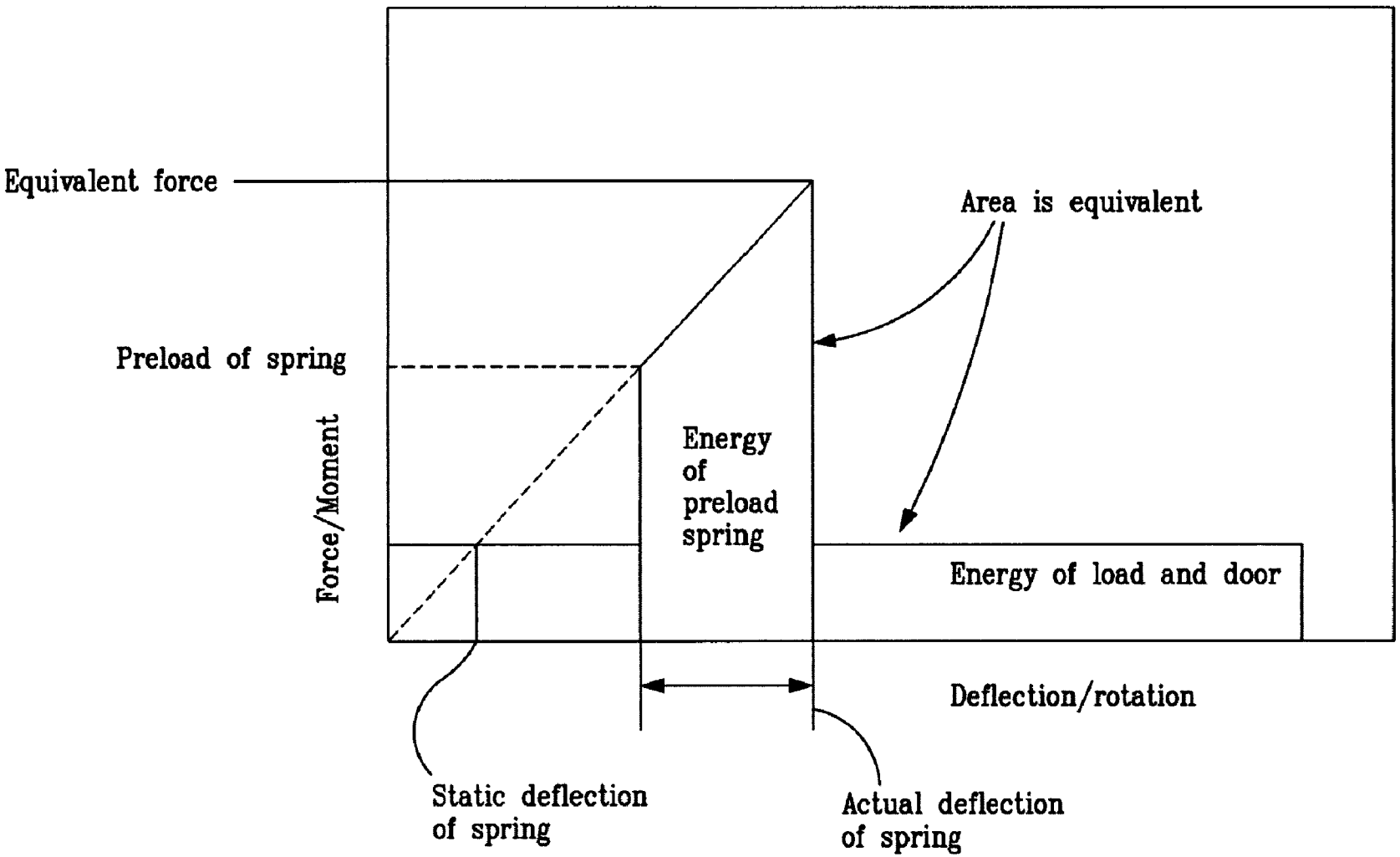
FIG. 4 is a graph illustration a force/moment applied to a door versus the deflection/rotation of the door in accordance with an exemplary embodiment.

An exemplary operation of the compliant hinge mechanism 290 will be described. FIG. 3A illustrates an exemplary graph of, for example, the normal force N applied at the center of the door 110 relative to a position of the door 110. As can be seen in the graph, the normal force N versus door position is plotted for both the compliant hinge mechanism 290 and a conventional break-away hinge. As illustrated in FIG. 3A, for both mechanisms, a relatively low and constant force is applied as the door moves from the closed position to the normal open position of approximately 90 degrees. When the preload on the pivoting member 210 is overcome by a load P applied to the door 110, the normal force N applied by the door through the hinge mechanism for the conventional break-away hinge decreases rapidly allowing the door to fall to the floor. Conversely, when the preload on the pivoting member 210 is overcome by a load P1 applied to the door 110, the normal force applied by the door through the compliant hinge mechanism 290 increases with respect to the door position. For example, in accordance with an exemplary embodiment, as the door 110 opens wider (e.g. past the first open position towards the second open position) the force applied to the door 110 by the compliant hinge mechanism 290 increases relative to the door open angle, in this example, to substantially prevent damage to the door 110 and/or floor and to substantially prevent spillage of the load P1. As can be seen in FIG. 3B, the resistance provided by the compliant hinge mechanism 290 to counter the opening of the door 110 past the first open position the resulting horizontal component Lx of the load P1 is of sufficient magnitude to substantially resist any tipping moment M that may be created by the load P1 being applied to the door 110.

It is noted that the increasing force applied to the door 110 by the compliant hinge mechanism 290 not only directs the horizontal force Lx (FIG. 3) of the load 400 to resist tipping of the appliance 100, the increased force also gradually decelerates the load to substantially prevent spillage of the load (e.g. prevents contents of a cooking tray from spilling out of the cooking tray).

It is noted that while the compliant hinge mechanism 290 is described using a coil or compression spring for exemplary purposes only, in alternate embodiments an extension spring, leaf spring, torsion spring or any other suitable springs may be used. It is further noted that in other alternate embodiments the resistance 220B may include a spring having a progressive spring rate such that the further the spring is compressed through the opening of the door 110, the greater the resistive force exerted by the spring against rotation of the door about pivot point 300. In still other alternate embodiments the variable spring loading may be accomplished through the use of a cam.

The hinge system 120 of the exemplary embodiments controls the static load on the door 110 by setting a preload on the resistance 220B. The preload on the resistance 220B is set to a predetermined load sufficient to resist the weight of a fully opened door (e.g., a door in the first open position) in addition to a predetermined static load applied to the open door 110. The preload on the resistance 220B may affect the minimization of door deflection when suddenly applied or dynamic loads are applied to the open door. The minimized deflection of the door 110 may substantially prevent the load from sliding off of the door 110 and falling to the floor. For exemplary purposes only, in one embodiment, the amount of deflection for a 40 lb static load applied to the door may be substantially zero deflection. As another example, for a 90 lb load the door may deflect towards the floor and the changing angle of the door creates a force vector which resists tipping of the appliance. This may eliminate the need for using an anti-tip bracket with the appliance 100 which decreases the installation time required to install the appliance 100. The implementation of the resistance 220B in the hinge system 120 is also more cost effective than using a hinge with multiple linkages.

Further, because the load on the door does not "breakaway" additional loading is required for increased door deflection, which may result in substantially preventing the door from impacting the floor. In one example, the hinge system 120 including the complaint hinge mechanism 290 can absorb about 500 in-lbs, because, for example, the compliant hinge mechanism 290 continues to absorb the load applied to the door over the full extended opening of the door past the first open position.

Thus, while there have been shown and described and pointed out fundamental novel features of the invention as applied to the exemplary embodiments thereof, it will be understood that various omissions and substitutions and changes in the form and details of devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An apparatus comprising:
- a frame;
- a door comprising a top and bottom; and
- a hinge mechanism hingably mounting the door to the frame, the hinge mechanism comprising:
  - a receiver mounted to the frame;
  - a resistance coupled to the receiver;
  - a pair of spaced-apart pins affixed to the receiver;
  - a pivoting member pivotably coupled to the receiver, the pivoting member comprising a single curved slot configured to receive the pair of spaced apart pins to allow the pivoting member to pivot about a pivot point in front of the frame and the bottom of the door;
  - a hinge component coupled to the door and configured to engage the pivoting member; and
  - wherein said resistance slidably engages a cam surface of said pivoting member to provide a preload to balance the door in a first open position and an increasing force resisting further opening of the door when the preload is overcome and the door is opened past the first open position.

2. The apparatus of claim 1, wherein the resistance is configured so that the increasing force increases depending on an open angle of the door.

3. The apparatus of claim 1, wherein the resistance comprises a spring.

4. The apparatus of claim 1, wherein the hinge mechanism further comprises a follower, the follower being coupled to the resistance and configured to engage one or more features of the pivoting member.

5. The apparatus of claim 4, wherein the pivoting member further comprises a detent, the follower being configured to engage the detent to balance the door in the first open position and to engage the cam surface when the door is further opened past the first open position, wherein the cam surface is configured to interact with the resistance through the follower to provide the increasing force.

6. The apparatus of claim 1, wherein resultant forces on the door when the door is opened past the first open position substantially resist tipping of the frame.

7. A cooking appliance comprising:
- a frame;
- a door comprising a top and a bottom; and
- a hinge mechanism hingably mounting the door to the frame, the hinge mechanism comprising:
  - a receiver mounted to the frame;
  - a pair of spaced-apart pins affixed to the receiver;
  - a pivoting member pivotablv coupled to the receiver, the pivoting member comprising a single curved slot configured to receive the pair of spaced apart pins to allow the pivoting member to pivot about a pivot point in front of the frame and the bottom of the door;
  - a hinge component coupled to the door and configured to engage the pivoting member; and
  - a resistance coupled to the receiver, wherein said resistance slidably engages a cam surface of said pivoting member to provide a preload to balance the door in a first open position and an increasing force resisting further opening of the door when the preload is overcome and the door is opened past the first open position.

8. The cooking appliance of claim 7, wherein the resistance is configured so that the increasing force increases depending on an open angle of the door.

9. The cooking appliance of claim 7, wherein the resistance comprises a spring.

10. The cooking appliance of claim 7, wherein the hinge mechanism further comprises a follower, the follower being coupled to the resistance and configured to engage one or more features of the pivoting member.

11. The cooking appliance of claim 10, wherein the pivoting member further comprises a detent, the follower being configured to engage the detent to balance the door in the first open position and engage the cam surface when the door is further opened past the first open position, wherein the cam surface is configured to interact with the resistance through the follower to provide the increasing force.

12. The cooking appliance of claim 7, wherein resultant forces on the door when the door is opened past the first open position substantially resist tipping of the appliance.

* * * * *